United States Patent [19]

White, Sr.

[11] 4,286,348

[45] Sep. 1, 1981

[54] SHOE LAST CONVERSION ASSEMBLY FOR LASTING BOOTS

[76] Inventor: Thomas P. White, Sr., 159 King St. East, Saint John, N. B., Canada, E2L 1G9

[21] Appl. No.: 72,787

[22] Filed: Sep. 5, 1979

[51] Int. Cl.[3] ..... A43D 3/00

[52] U.S. Cl. ..... 12/133 R

[58] Field of Search ..... 12/133 R, 133 A, 133 B, 12/136 R, 136 B, 136 C

[56] References Cited

U.S. PATENT DOCUMENTS

| | | | |
|---|---|---|---|
| 373,840 | 11/1887 | McNamara | 12/133 R |
| 429,782 | 6/1890 | Spiller | 12/133 B |
| 1,547,298 | 7/1925 | Casenave | 12/133 A |
| 2,135,173 | 11/1938 | Clausing | 12/133 B |

*Primary Examiner*—Patrick D. Lawson

*Attorney, Agent, or Firm*—Cushman, Darby & Cushman

[57] ABSTRACT

A conventional shoe last is provided with an adapter assembly to facilitate lasting of boots and/or other ankle-covering malleoli circumventing footwear. The assembly includes an upward extension that has medially, laterally adjustable medial and lateral portions, each preferably with an adjustable cup-forming member, and each with a skirt for filling in around the thinner top backpart of the conventional shoe last. The V-notch of the conventional shoe last is provided with an adjustable cone portion that at least partially covers the cone portion of the shoe last in order to provide the close fit needed for active wear boots.

4 Claims, 11 Drawing Figures

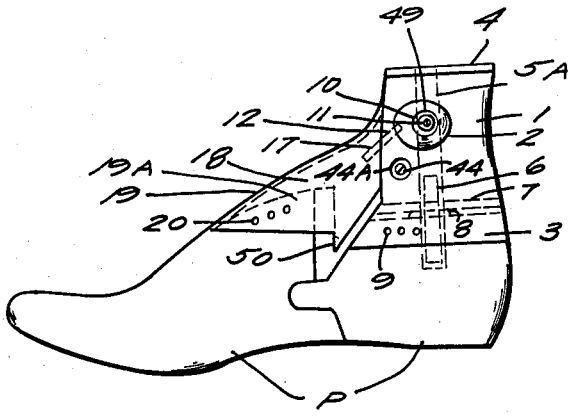
Fig. 1
Fig. 2
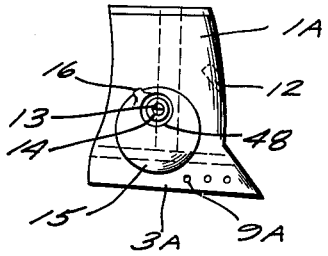
Fig. 3
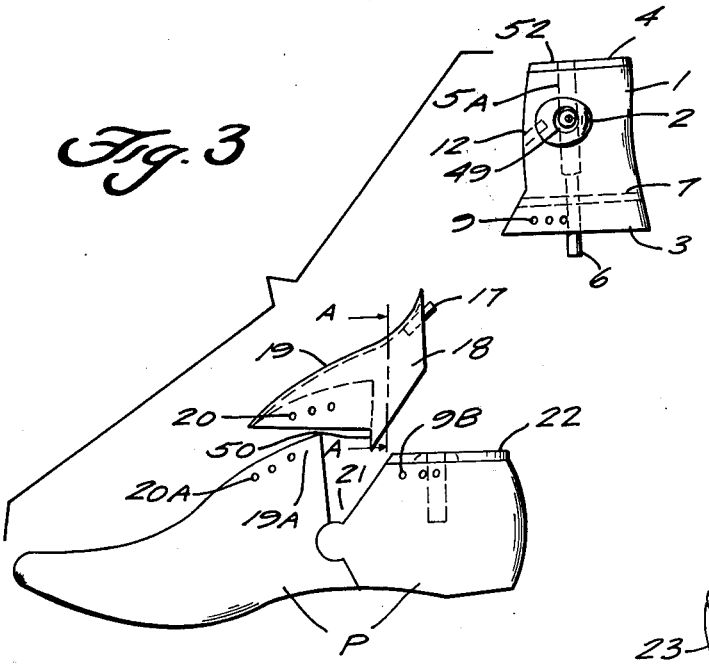
Fig. 4
PRIOR ART
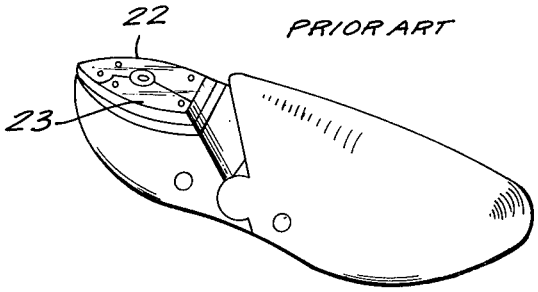

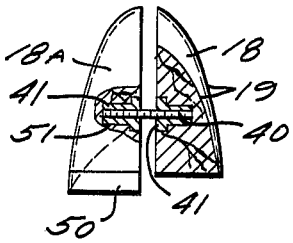
Fig. 5
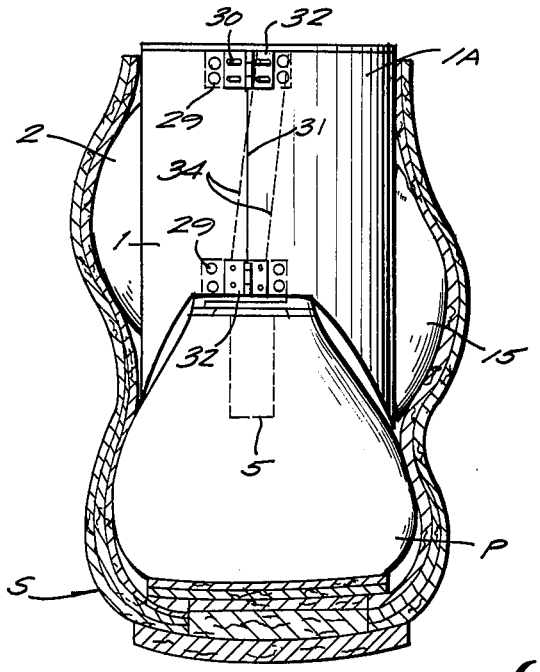
Fig. 6
Fig. 7
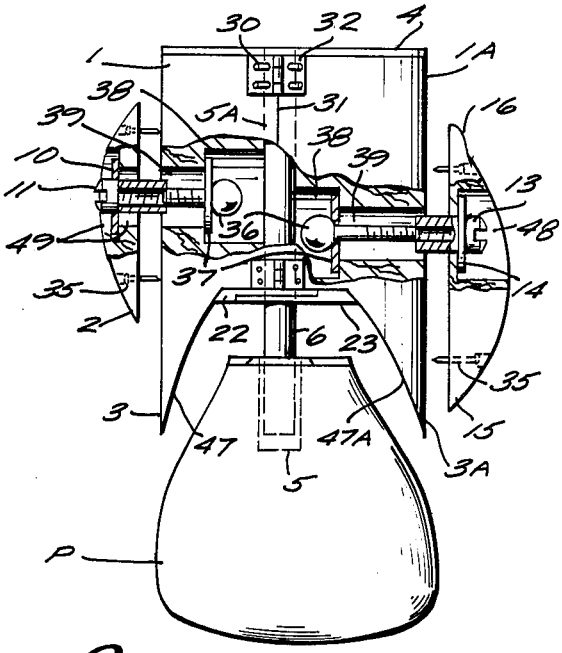
Fig. 9
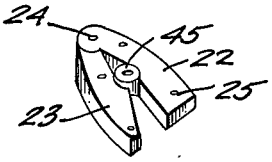
Fig. 8
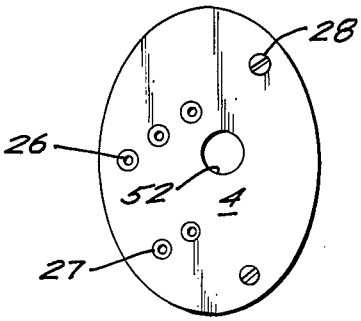
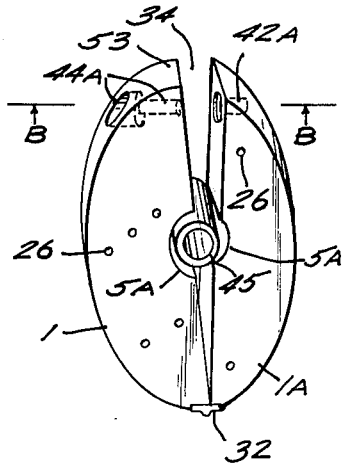
Fig. 10
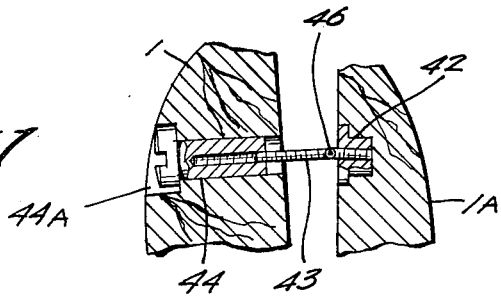
Fig. 11

SHOE LAST CONVERSION ASSEMBLY FOR LASTING BOOTS

FIELD OF THE INVENTION

The present invention relates to boot lasts and more particularly to an adjustable assembly mountable on a conventional shoe last for converting the conventional shoe last for production of boots, other high-topped footwear and the like.

BACKGROUND OF THE INVENTION

Previously, the present inventor has patented a skate boot in U.S. Pat. No. 3,659,361, issued May 2, 1972, and a transversely adjustable boot in U.S. Pat. No. 3,748,756, issued July 31, 1973. One problem encountered by the inventor in attempt at commercialization of those boots has been the apparent lack in the marketplace of boot lasts which could readily be used to last the uppers for those boots. Accordingly, the present invention arose as a way of overcoming that problem. The result is an invention which may be used in the manufacture of those boots and the uppers of other ankle-covering footwear, which circumvent the malleoli.

Conventional boot last extensions extend vertically, from where they are attached to a boot last body. The conventional boot last body already projects to a height beyond the malleoli (anklebones) and the extensions are attached to extend from above the malleoli; so that no consideration is given to the treatment of the high top shoe quarter in the area of the malleoli. Conventional boot last extensions are specifically structured for the manufacture of particular types of boots, such as arctic boots, rubber boots and gaiters which had to be built in such an outsize that they could accommodate the whole foot, anklebones and all, into said boots without the necessity of having fastening or lace openings therein. Boots of that kind are incapable of supporting the ankles in athletic games and/or other strenuous activities, as should boots of my above-mentioned earlier patented inventions.

A "boot last body" as used herein is one that extends up to and/or beyond the malleoli (anklebones); a "shoe last" as used herein is one that extends upwardly and is curved inwardly at the back part in a manner that requires the low top shoe quarter to clip on in a position terminating below the malleoli (anklebones). It is to a shoe last, not to a boot last body, that the shoe last extension of the present invention is removably secured. This is in contrast to the prior art in which boot last extensions are attached to the aforementioned boot last body.

The expression "medial" means that part of the last which forms the inside upper of a boot; or to the middle, toward the mid-line of the wearer's body. The expression "lateral" is that part of the last which forms the outside of the boot uppers; or to the outside, toward the flanks of the wearer's body.

For the purposes of this description "foot/leg" defines the meeting area of the lower ending of the leg into the top part of the foot and is the area from which the lateral malleolus (outside anklebone) and the medial malleolus (inside anklebone), which is higher up than the lateral malleolus, protrude.

Unitary boot/leg lasts have been devised in the past for such boots as gaiters, but they do not permit the lasting of boots to completely follow the contour of the foot/leg in the area of the malleoli (anklebones) protrusions.

SUMMARY OF THE INVENTION

In a preferred practice of the present invention, a conventional shoe last is provided with an adapter assembly to facilitate lasting of boots and/or other ankle-covering malleoli circumventing footwear. The assembly includes an upward extension that has medially, laterally adjustable medial and lateral portions, each preferably with an adjustable cup forming member, and each with a skirt for filling in around the thinner top back part of the conventional shoe last. The V-notch of the conventional shoe last is provided with an adjustable cone portion that at least partially covers the cone portion of the shoe last in order to provide the close fit needed for active wear boots.

The present invention provides a last assembly that is constructed to permit the leather or synthetic lasting material to be stretched over the last so that when removed from said last the lasted material will closely follow the contour of the foot in the high top shoe quarter area without having to allow for an excess of said material necessary when required to pass over the bony protrusions of the malleoli (anklebones). To allow the lasted material of a high top shoe quarter to closely follow the contour of the foot in the high top shoe quarter area, cup forming members are provided. By preference, a generally ball-shaped segment is attached in a removably secured and radially adjustable manner to the lateral side portion of the vertical shoe last extension by means of a ball-headed bolt and washer in a recess on the inner side of the lateral shoe last extension portion, this bolt projecting through an enlarged horizontal cylindrical hole which gives the bolt freedom to move or adjust radially. This bolt in the preferred embodiment is connected to a second ball-headed bolt projecting through the ball segment shaped cup shaping member. This arrangement allows for the adjusting of the cup shaping member to form cups in the high top shoe quarter in varying locations corresponding to varying locations of the malleolus on different individuals.

A similar arrangement is made for attaching the generally elipsoidal segment cup shaping member to the medial side portion of the shoe last extension. The shoe last lateral and medial portions preferably are hinged at the rear and the hinges may have a slot for the fastening screws or pins to slide in if it is desired to adjust the two portions in this area; or a larger hinge with wider spaced screw holes may be used to accomplish this. A central vertical shaft is formed between the medial and the lateral shoe last extensions, when closed, to hold the joining pin and the lasting pin. Spacers may be inserted over the said joining pin and/or lasting pin in quantities of one or a plurality thereof for the purpose of holding the two vertical extensions apart when it is desired to adjust them transversely fo fit for a thicker leg lasting.

Further means of transversely adjusting the medial side portion and the lateral side portion transversely on the shoe last is provided, including a plate which is securely fastened to the top of one side portion and removably secured to the top of the opposite side portion with removable fasteners. This plate has an opening centrally thereof dimensioned to receive the lasting pin. When adjusting transversely is desired, the pins are removed from one side of the plate, the last portions readjusted, and the pins reinserted in the plate after the spacers have been put on or removed from the joining and/or lasting pins as the cause may be. Preferably, at the bottom surfaces of the medial side portion and the lateral side portion that mates with the top of the shoe last, a scissored plate is attached to the bottom of the two vertical shoe last extension portions and which will allow them to open or close as desired. Near the lower end of the vertical last extension preferably, a toggle pin means may be inserted to adjust and retain same in this area.

Conventional shoe lasts are narrowed-in in the backpart more thinly than is the foot in this area, the purpose being that when the lasted shoe is pulled on the foot it is opened with the fingers and allowed to clip onto the thicker foot just below the malleoli (anklebones). This narrowed portion is undesirable for lasting boots so this vacated space is filled by a skirt like portion of the lateral and medial vertical shoe last extensions in the apparatus of the invention. These continue down past the mating plates of the shoe last and the shoe last extensions to fill the void left by this narrowing of the backpart of a conventional shoe last. One or, a plurality of fastening pin means are inserted through the skirt and into the backpart of the conventional shoe last removably securing it to the conventional shoe last.

A transversely adjustable cone portion is provided and dimensioned to fit into the V shaped notch between the forepart and the backpart of the conventional shoe last when said last is designed to break these two parts towards each other for the easy removal of the lasted shoe. This cone portion has a hood and is removably secured by pin or a plurality of fastening pin means to the forepart of the shoe last. The hood portion is dimensioned so that it will not slide off the shoe last cone when a larger shoe last is employed, it being longer at the top of the V-notch from the shoe last cone of its forepart, to the backpart heel.

The present invention provides a last useful for making boots of the type shown in my aforementioned two prior U.S. Pat. Nos. 3,659,361 and 3,748,756, and for making similar ankle-covering malleoli circumventing footwear uppers.

BRIEF DESCRIPTION OF THE DRAWINGS

In the Drawings

FIG. 1 is a medial side elevation view of a divided shoe last extension which is transversely adjustable and removably secured to and in combination with a conventional shoe last and also having in combination a divided cone portion which is transversely adjustable and removably secured to a lateral cone portion all of the foregoing parts being removably secured to and in combination with a conventional shoe last.

FIG. 2 is a side elevation view of the lateral side portion of the shoe last extension with the ball segment lateral cup forming member thereon.

FIG. 3 is an exploded medial side elevation view of the apparatus of FIG. 1.

FIG. 4 is a perspective view of a conventional shoe last showing a scissored mating plate of FIG. 7 provided thereon.

FIG. 5 is a front elevation view of the cone portion of the apparatus of FIG. 3, with portions broken away and sectioned to expose internal details.

FIG. 6 is a transverse vertical sectional view of a skate boot of the type shown in FIG. 8 of my aforesaid earlier U.S. Pat. No. 3,659,361 showing how the apparatus of the present invention (shown in rear elevation) would cooperate to form that boot.

FIG. 7 is an exploded rear elevation view of the combination of the shoe last and the shoe last extension together with the cup forming members.

FIG. 8 is a perspective view of the scissored mating plate of FIG. 7.

FIG. 9 is a top plan view of the plate shown at the top of the extension in FIG. 1. FIG. 10 is a perspective view from above of the medial side portion and lateral side portion of the shoe last extensions of FIG. 7.

FIG. 11 is a fragmentary horizontal sectional view of the medial and lateral shoe last extensions of FIG. 10, showing the pin means provided for expansion and retention of these extensions relative to one another.

DETAILED DESCRIPTION OF THE PRESENTLY PREFERRED EMBODIMENT OF THE INVENTION

Referring first to FIG. 7, P is a shoe last, which may be of a conventional, widely commercially available prior art type. From the shoe last P, the medial side and lateral side shoe last extensions 1 and 1A respectively extend vertically on a joining pin 6 that is inserted into the shoe last thimble 5 and continues up into a shaft 5A formed centrally in the medial 1 and lateral 1A shoe last extensions when they are in a fully closed position. The joining pin 6 is dimensioned to end where it would meet the lasting pin when the whole is placed on such a lasting pin in an inverted, work position. Also shown provided is one or a plurality of hinges 32, slotted as at 30 so that the rear fastening means will slide to allow transverse expansion of the medial 1 and the lateral 1A shoe last extension side portions at their rear vertical parting line 31. Alternatively a larger hinge with wider holes may be provided to allow for transverse expansion at the rear, if desired.

A scissored mating plate with parts 22 and 23 is shown fastened to the medial 1 and lateral 1A side portion extensions where they bottom and meet the top plate on the backpart of the shoe last P and the mating plate is scissored with portions 22 and 23 in order that the medial 1 and lateral 1A side portion extensions may be adjusted transversely, if desired. The pin fastener means may be removed from one side of the scissors if it is necessary to transversely adjust the extension at the rear thereof. The medial side portion 1 projects downwardly below the plane of the mating plate 22 and the top plate of P forming a skirt 3. Instead of fitting the carved-out narrow top of the conventional backpart of the shoe last, the inner side 47 of the skirt 3 is concave so that it will readily mate with a larger-sized conventional last P when used therewith. For the same reason the lateral side portion downward projection 3A is concave at 47A. A top plate 4 secures the medial 1 and lateral 1A side portion extensions in a fixed position after adjusting said parts to the desired position in transverse relation to each other.

Referring now to FIG. 3, the skirt 3 is shown having a plurality of holes 9 in a corresponding relation to the holes 9B in the backpart of the shoe last for pin fastener means of removably securing the shoe last medial side portion 1 to the shoe last P in order that the shoe last extensions 1 and 1A may be transferred to various shoe lasts. This pin fastener means is for removably securing both extensions to the shoe last P, the skirt 3A (FIG. 2) and the skirt 3 (FIG. 3). These skirts may extend and meet at the backcurve of the shoe last P, FIG. 1, or skirt 3A and skirt 3 may stop short of surrounding the back-curve of the shoe last as depicted in FIG. 7.

A cone portion with parts 18 and 18A is dimensioned to fit in the V notch 21 of the shoe last cone 19A. A hood 19 of cone portions 18 and 18A overlaps the cone 19A of the shoe last so that when the cone portions 18 and 18A are transferred to a larger and/or longer shoe last P, the hood 19 will not be completely withdrawn from covering, or partly covering the shoe last cone 19A. The retention of the divided cone portions 18 and 18A is further assisted by dowel means 17 singly or in plurality angled up to fit in the hole or holes 12 in the shoe last extensions 1 and 1A. The dowels 17 are fitted removably into the holes 12 and dowels of varying lengths may be used if desired when the cone portion is transferred to varying sized shoe lasts P, but pin means are used to more securely attach the cone portion hood 19 to the shoe last cone 19A through the holes 20 in the hood 19 and holes 20A in the shoe last cone 19A provided therefor. The divided cone portion is further illustrated in FIG. 5 wherein the medial cone portion 18 provides a section taken through the medial cone portion 18 as indicated by the cutting plane 'A—A' in FIG. 3 showing the point at which the medial half 18 and the lateral half 18A of the divided cone portion are attached by pin means, preferably by means of a threaded stud 40 which is screwed into serrated nuts 41 having shoulders at their outer faces. These nuts 41 are pressed into holes 51 provided on the inner dividing faces of the cone portions 18 and 18A and will not turn as will be apparent from the cutaway area of the lateral side portion 18A in FIG. 5 where the lower portion of the face 50 of the wedge shaped part of the divided cone portion also is depicted.

Preferably an elipsoidal-shaped segment or cup-forming member 2 is, by pin means, removably secured to the medial side portion 1 of the shoe last extension preferably with a ball-headed machine screw 36 and has a fillister face on the outside ball 11 the curvature of which generally follows the curvature of the elipsoidal shaped segment 2. A washer 10 set in a larger recess 49 allows the elipsoidal segment 2 to be adjusted radially on the outer face of the extension 1 assisted by a horizontal hole 39 the outside dimension of which is greater than the outside dimension of the pin means. The hole 39 extends through into a cylindrical recess 38 created in the inside face of the medial side portion extension 1 and a washer 37 of less outside diameter than the cylindrical recess 38 in order to further assist the radial adjustment of the cup forming member 2 provides the leverage for the ball head 36. Also, preferably, a ball-shaped segment or cup-forming member is held by pin means to the lateral side portion shoe last extension, preferably by a ball-headed machine screw 36 having a fillister face on the outside ball head and with a screw driver slot in same. A washer 14 of lesser outside diameter than the recess 48 and created to receive same provides the leverage for and allows the pin means to move radially on the outside face of the lateral side portion extension 1A assisted in this movement by a horizontal hole 39 having an outside diameter greater than the outside diameter of the pin means. The hole 39 extends through to a cylindrical recess 38 created in the inside face of the lateral side portion 1A, which recess 38 has an outside diameter greater than the washer 37 further assisting in the radial movement of the cup forming ball segment member 15. Pin means, preferably tacks 35 may be used for the steadying of the positioned cup forming members in instances where the material of the last extension is such that it will take tacks. In the top portion of the ball-shaped cup-forming member 15 and slightly to the rear of centre extending slightly through the periphery of the upper edge of cup-shaping member is a small spur 16, provided for the purpose of creating the indent in the integral lateral cup member e.g. of the skate boot shown in FIG. 8 of my aformentioned U.S. Pat. No. 3,659,361 and that would correspond to the indent shown in FIG. 5 of that patent.

Returning to FIG. 3, hereof, a most important feature of the cup-forming members is shown wherein the elipsoidal shaped segment 2 is higher up on the medial side portion 1 of the shoe last extension than is the ball-shaped segment 15 on the lateral side portion 1A FIG. 2. A further feature is that the elipsoidal-shaped segment 2 is placed more to the fore than is the ball-shaped segment 15, which is lower and more centred on the lateral side portion 1A FIG. 2. This is done so that each respectively corresponds to the same positioning in the foot/leg of its respective malleolus. A spur 16, FIG. 2 at the top of and partly to the rear of the ball-shaped segment is for the purpose of forming an indent in the cup, e.g. of the skate boot shown in FIG. 8 of my aforementioned U.S. Pat. No. 3,659,361 when it is preferred, such as when stiffer materials are used in the lasting, e.g. plastic or other composition materials. The spur 16 would break through the base of the periphery of the cup and form an indent in said cup corresponding to the position of the large tendon extending upwardly from the lateral malleolus (anklebone). It will become apparent from FIG. 2 and FIG. 3 of my aforementioned U.S. Pat. No. 3,659,361 that this variation of the skate boot does not require the cup forming members 2 and 15 of the present invention, to be attached to the medial 1 and lateral 1A side portion shoe last extensions, because there is then no requirement to have to deal with lasting over the bony protrusion of the malleoli. The shoe last extensions of this invention are novel, in that they allow the lasting material to be lasted in a manner that it will more closely follow the contour of the foot/leg when removed from the last, a feature which is not possible with conventional boot lasts and/or boot last extensions, including shoe last extensions designed for rubber boots, gaiters and the like.

The conventional shoe last or prior art is depicted in a pictorial view in FIG. 4 and to better illustrate the scissored mating plate 22 and 23 of FIG. 7, it is shown in FIG. 4 resting on, or engaging the conventional plate of the prior art shoe last, when it is attached to the bottom ends of the shoe last extensions 1 and 1A before fitting thereupon said prior art shoe last. FIG. 8 is a further pictorial view of the scissored mating plate 22 and 23 hinged at 24 and has holes 25 provided for the removable pin fastener means of attachment to the extensions 1, 1A. This scissored plate 22 and 23 allows for the transverse opening and/or closing of the divided last extensions as indicated at 34 of FIG. 10. If the rear division 31 is desired to be expanded transversely on the slotted hinges 30 or alternatively by means of a larger hinge with wider holes 29 as shown in FIG. 7, then the removable fastening pins of, preferably the medial scissor 22, may be removed and replaced as described below for 26 of FIG. 9 and FIG. 10. It is seen how the jaws of the scissors can be held apart by the illustration of a spacer 45 in FIG. 8. FIG. 9 is a top plan view of the plate 4 of FIG. 1 having an opening 52 to receive the lasting pin. The plate 4 may be attached by fasteners 28 to one of the shoe last extension side portions, preferably to the lateral side portion 1A. Staggered holes 27 allow for insertion of removable fasteners which go into the corresponding holes 26 of FIG. 10, or some of the said holes 26 so that when it is desired to expand or transversely retract the two shoe last extension side portions 1 and 1A, these removable fasteners are removed and replaced in corresponding staggered holes 26 (FIG. 10) when the desired position has been established by the insertion or deletion of spacers 45. FIG. 10 is a pictorial top perspective view of the divided shoe last extensions 1, 1A attached at the rear by hinge means 32 which may be slotted 30 for the fasteners to allow them to slide in said slots if it is desired to expand the extensions at their rear division 31; or 32 may be replaced by larger hinges 29 with wider apart fastening means, which would accomplish said expansion as well. The lateral side portion has a hole 42A in the front to receive a serrated nut 42 of FIG. 11, therein and a corresponding hole 44A is provided in the front of the medial side portion 1 to receive the toggle screw 44 of FIG. 11. The holes 26 in the medial side portion 1 are staggered so that when the fasteners are removed and one or more spacers 45 force the gap 34 to open or close the division of the extensions, then when the new position of the divided parts are reached the fasteners are resecured in the new position in corresponding staggered holes 27 in the plate of FIG. 9.

The medial side portion 1 is carried around more to the forefront of the foot as depicted at 53 than is the lateral side portion 1A, so that the gap 34 is angled in front from a point beginning at or about the bend of the instep and angling upwardly and laterally a few degrees as illustrated 34 of FIG. 6. The purpose of this, e.g. in the manufacture of a skate boot S is to give more wrap-around room to the medial high top shoe quarter in order to have a surface on which to fasten the flange of the skate boot's elipsoidal-shaped cup member, because whereas the medial malleolus of the foot is more forward than is the lateral malleolus, room on the lateral high top shoe quarter can be spared and, therefore, room can be added to the medial high top shoe quarter, so the gap 34 will not now fall in the lasting area of the inside high top shoe quarter, but will occur between the upwardly and outwardly angled opposing lacing edges of the boot from the instep up.

FIG. 11 indicates a section taken through the medial 1 and lateral 1A side portion extensions of FIG. 10 taken on a cutting plane 'B—B' showing the point at which both halves of the shoe last extensions are attached by pin means, preferably by a toggle screw 44 and a threaded stud 43 having a hinge pin 46 and a serrated nut 42. These toggle pins could be used in quantities of one or a plurality of pin means and holes for adjusting and holding the divided shaft 5A against the holding pin 6, FIG. 7 and the last pin, or against the spacer, or spacers 45 when used.

In FIG. 1 the dotted lines defining space 7 show the position of the mating plate 22–23, and the dotted line space 8 below them shows the position of the conventional shoe last plate upon which it rests.

The critical facet of boot last extension inventions in the past seemed to be caught-up in the particular method of joining the extension to the boot last body, and while I have disclosed a particular way of attaching shoe last extensions to a shoe last, this is not the only way, since any equivalent form of joining these parts may be employed here.

Accordingly, the present invention is seen to provide last extensions for removably securing to conventional shoe lasts comprised of a medial side portion and a lateral side portion, adjustable transversely and attached to each other in a vertical position by plate and pin means. The adjustment feature may include one or a plurality of spacers dimensioned to fit one over the other in sleeve like fashion, for the purpose of retaining the two shoe last extension portions in chosen degrees of transverse expansion, when fitted over the joining pin and/or lasting pin. Each shoe last extension side portion is dimensioned in the area of the respective malleolus to allow the lasting leather or synthetic lasting material to closely follow the contour of the foot/leg, when said material is removed from the last, without having to take into consideration the greater distance of passing over the protruding malleoli because when the cup forming members are present on the last extension the leather or synthetic material will be pressed down tight against the last. Thus, one may form the cups in the high top shoe quarter of lasted boots of the kind shown in FIG. 8 of my aforesaid U.S. Pat. No. 3,659,361. The last extension further facilitates the forming of the counters shown in FIGS. 19, 20, 21 and 22 of the transversely adjustable boot shown in my aforesaid U.S. Pat. No. 3,748,756. The present invention thus facilitates the manufacture of the aforesaid boots.

The backpart of conventional shoe lasts is thinner than a normal foot/leg, thus the medial side portion 1 and the lateral side portion 1A of the shoe last extension of the present invention preferably continues downward past the top of the conventional shoe last backpart forming a skirt-like downward projection into the thinned out area of said backpart.

Pin means are inserted through the said medial and lateral skirts into the carved out backpart for attaching the last extension to the shoe last in a removably secured state. Cup-forming members, one a generally ball-shaped segment and the other a generally ellipsoidal-shaped segment are radially adjustable and removably secured to the last extensions in a relationship corresponding to the malleoli as determined for different people.

A cone portion is removably secured in the V-shaped notched area usually provided in conventional shoe lasts for the purpose of allowing the backpart of break towards the forepart in order to remove the lasted footwear. This cone portion is divided into two parts, i.e., longitudinally split into a medial side and a lateral side, each having a hood portion 19 and these two parts are transversely adjustable by one or a plurality of pin means passing transversely into each other, or partly therethrough from the inside faces of the divided cone portion. The hood of the cone portion attaches the hood portion to the shoe last cone by pin means through said hood into said shoe last cone. Dowels projecting from the medial extension portion into the medial cone portion and from the lateral extension portion into the lateral cone portion further retains the cone portion in the V-notch of the shoe last. Hinge means or plurality of hinge means alternatively interchangeable with a larger or wider hinge provides for slight transverse adjustment at the rear of the medial 1 and lateral 1A side portions of the shoe last extensions.

It should now be apparent that the shoe last conversion assembly for lasting boots as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For lasting boots and similar footwear having an upper that preferably does not, although may cover but not engage the wearer's medial and lateral malleoli, if covering is preferred of said malleoli, and for converting to such purpose a conventional shoe last which includes a forepart articulably joined to a backpart at a juncture region which includes a V-notch to permit articulation of the forepart relative to the rearpart for removal of the shoe last from a footwear upper formed thereabout; the forepart including a cone portion; and the backpart terminating at an upper end which lies below the malleoli;

an adapter assembly, comprising:

an upward extension for the backpart, including a medial vertical shoe last extension member and a lateral vertical extension member grouped together; means adjustably disposing the medial and lateral shoe last extension members adjustably fixed in lateral adjacency with a variable distance therebetween;

means for removably mounting the extension on the backpart so that the shoe last extension members extend above the malleolian level;

said shoe last extension including a skirt which, when the shoe last extension is mounted in place extends down around the exterior of the shoe last for part of the height of the shoe last;

a cone sub-assembly including a medial side portion, a lateral side portion and means for adjustably fixing these portions in lateral adjacency with a variable distance therebetween; the cone sub-assembly being externally configured at the bottom rear thereof to fit into the V-notch of the shoe last juncture region; the cone sub-assembly including a hood;

means for securing the cone-sub-assembly to the shoe last extension so that the cone sub-assembly hood at least partially covers-over the shoe last cone as a functionally somewhat enlarging structure therefor.

2. The apparatus of claim 1, further comprising:

a medially projecting ball-shaped, medial malleolus cup-forming member adjustably secured on the medial vertical shoe last extension member; and a laterally projecting ellipsoidal-shaped, lateral malleolus cup-forming member adjustably secured on the lateral vertical shoe last extension member.

3. For lasting boots and similar footwear having an upper that preferably does not cover the wearer's medial and lateral malleoli, but cups that do not engage the malleoli may be provided, if desired, boot lasting apparatus, comprising:

a shoe last which includes a forepart articulably joined to a backpart at a juncture region which includes a V-notch to permit articulation of the forepart relative to the rear part for removal of the shoe last from a footwear upper formed thereabout; the forepart including a cone portion; and the backpart terminating at an upper end which lies below the malleoli; and an adapter assembly, comprising:

an upward extension for the backpart, including a medial vertical shoe last extension member and a lateral vertical extension member grouped together; means adjustably disposing the medial and lateral shoe last extension members adjustably fixed in lateral adjacency with a variable distance therebetween;

means for removably mounting the extension on the backpart so that the shoe last extension members extend above the malleolian level;

said shoe last extension including a skirt which, when the shoe last extension is mounted in place extends down around the exterior of the shoe last for part of the height of the shoe last;

a cone sub-assembly including a medial side portion, a lateral side portion and means for adjustably fixing these portions in lateral adjacency with a variable distance therebetween; the cone sub-assembly being externally configured at the bottom rear thereof to fit into the V-notch of the shoe last juncture region; the cone sub-assembly including a hood;

means for securing the cone sub-assembly to the shoe last extension so that the cone sub-assembly hood at least partially covers-over the shoe last cone as a functionally somewhat enlarging structure therefor.

4. The apparatus of claim 3, further comprising:

a medially projecting ball-shaped, medial malleolus cup-forming member adjustably secured on the medial vertical shoe last extension member; and a laterally projecting ellipsoidal-shaped, lateral malleolus cup-forming member adjustably secured on the lateral vertical shoe last extension member.

* * * * *